US008414510B2

(12) United States Patent
Wu et al.

(10) Patent No.: US 8,414,510 B2
(45) Date of Patent: Apr. 9, 2013

(54) MASSAGE DEVICE WITH A MASSAGE HEAD DISTANCE ADJUSTING MECHANISM

(75) Inventors: Chichun Wu, Guangdong (CN); Zhao Zhang, Guangdong (CN)

(73) Assignee: Chichun Wu, Dongguan, Guangdong Province (CN)

( * ) Notice: Subject to any disclaimer, the term of this patent is extended or adjusted under 35 U.S.C. 154(b) by 365 days.

(21) Appl. No.: 12/831,710

(22) Filed: Jul. 7, 2010

(65) Prior Publication Data

US 2010/0318008 A1 Dec. 16, 2010

Related U.S. Application Data

(63) Continuation-in-part of application No. 12/829,843, filed on Jul. 2, 2010, which is a continuation-in-part of application No. 12/551,078, filed on Aug. 31, 2009, now Pat. No. 8,123,708.

(30) Foreign Application Priority Data

| | | |
|---|---|---|
| Jul. 10, 2009 | (CN) | 2009 2 0133729 U |
| Aug. 31, 2009 | (EP) | 09169089 |
| Mar. 22, 2010 | (EP) | 10157222 |

(51) Int. Cl.
*A61H 7/00* (2006.01)
*A61H 19/00* (2006.01)

(52) U.S. Cl.
USPC ..... 601/98; 601/90; 601/134

(58) Field of Classification Search ..... 601/49, 601/56–60, 84–87, 90, 91, 93, 94, 97–101, 601/601/103, 112, 113, 115, 116, 124, 126, 601/127, 133–136
See application file for complete search history.

(56) References Cited

U.S. PATENT DOCUMENTS

| | | | | |
|---|---|---|---|---|
| 3,207,152 | A | 9/1965 | Thornton | |
| 3,800,785 | A | 4/1974 | Inada | |
| 5,020,518 | A | 6/1991 | Spears et al. | |
| 5,630,790 | A | 5/1997 | Ito | |
| 5,807,288 | A | 9/1998 | Wu | |
| 6,443,917 | B1 * | 9/2002 | Canto | 601/99 |
| 7,128,721 | B2 * | 10/2006 | Ferber et al. | 601/86 |
| 7,306,570 | B1 | 12/2007 | Julian | |

(Continued)

FOREIGN PATENT DOCUMENTS

| | | | |
|---|---|---|---|
| CN | 201244170 | T | 5/2009 |
| CN | 201469637 | U | 5/2010 |

(Continued)

*Primary Examiner* — Kristen Matter
(74) *Attorney, Agent, or Firm* — Morris Manning & Martin LLP; Tim Tingkang Xia, Esq.

(57) ABSTRACT

A massage device has a massage head distance adjustment mechanism. In one embodiment, the massage head distance adjustment mechanism includes a first motor, a first worm coaxially connected to the first motor, a first worm wheel meshing with the first worm, a first gear meshing with the first worm wheel, and a pair of second gears having one second gear meshed with the first gear. The pair of second gears meshes with each other. In operation, the first motor drives, in sequence, the first worm, the first worm wheel, the first gear, and the pair of second gears, thereby causing the pair of massage heads to move along a corresponding pair of arc-shaped slots. Accordingly, the distance between the two massage heads is adjusted.

9 Claims, 6 Drawing Sheets

U.S. PATENT DOCUMENTS

| | | | | |
|---|---|---|---|---|
| 8,123,708 | B2 * | 2/2012 | Wu et al. | 601/112 |
| 2003/0018284 | A1 | 1/2003 | Lim | |
| 2004/0049136 | A1 | 3/2004 | Lin | |
| 2004/0171972 | A1 | 9/2004 | Shimizu et al. | |
| 2005/0015029 | A1 | 1/2005 | Kim | |
| 2005/0020946 | A1 | 1/2005 | Kim | |
| 2005/0090770 | A1 | 4/2005 | Chen | |
| 2005/0096571 | A1 | 5/2005 | Miki | |
| 2005/0113723 | A1 | 5/2005 | Ueyama et al. | |
| 2005/0256434 | A1 * | 11/2005 | Luo | 601/86 |
| 2006/0069331 | A1 | 3/2006 | Huang | |
| 2007/0118059 | A1 | 5/2007 | Luo | |
| 2008/0161736 | A1 | 7/2008 | Leifer | |

FOREIGN PATENT DOCUMENTS

| | | | |
|---|---|---|---|
| EP | 0809993 | A2 | 12/1997 |
| EP | 1145701 | A1 | 10/2001 |
| EP | 1400230 | A1 | 3/2004 |
| EP | 1568344 | A2 | 8/2005 |
| EP | 1595521 | A1 | 11/2005 |
| EP | 2080499 | A1 | 7/2009 |
| JP | 2000051302 | A | 2/2000 |
| WO | 01/60310 | A1 | 8/2001 |
| WO | 02/069880 | A1 | 9/2002 |
| WO | 02/094169 | A2 | 11/2002 |
| WO | 2008/036955 | A2 | 3/2008 |

* cited by examiner

MASSAGE DEVICE WITH A MASSAGE HEAD DISTANCE ADJUSTING MECHANISM

CROSS-REFERENCE TO RELATED PATENT APPLICATION

This application is a continuation-in-part of U.S. patent application Ser. No. 12/829,843, filed Jul. 2, 2010, entitled "Massage Device," by Chichun Wu and Zhao Zhang, which itself is a continuation-in-part of U.S. patent application Ser. No. 12/551,078, now U.S. Pat. No. 8,123,708, filed Aug. 31, 2009, entitled "Massage Device," by Chi-Chun Wu and Chi-Wu Chiang. Each of the above-identified disclosures is incorporated herein in its entirety by reference.

This application claims priority to and the benefit of, pursuant to 35 USC §119(a), Chinese patent application Serial No. 200920133729.0, filed Jul. 10, 2009, entitled "MASSAGE DEVICE WITH A MASSAGE HEAD DISTANCE ADJUSTING MECHANISM," by Chichun Wu, EP patent application No. EP10157222.0, filed Mar. 22, 2010, entitled "Massage Device with a Locking Mechanism" by Chi Chun Wu, and EP patent application No. EP09169089.1, filed Aug. 31, 2009, entitled "Massage Device," by Chi-Chun Wu and Chi-Wu Chiang. Each of the above-identified disclosures is incorporated herein by reference in its entirety.

FIELD OF THE INVENTION

The present invention relates generally to a massage device, and more particularly to a massage device with a massage head distance adjusting mechanism.

BACKGROUND OF THE INVENTION

With the improved living standard in modern times, people are experiencing faster social pace and higher levels of stress. To reduce stress, various ways of relaxation and exercise have become increasingly important in people's daily lives. Consequently, various sports and health apparatuses have become household items. In particular, for people who spend long hours reading, writing, or in front of computers, they often experience severe sore and pain in the neck and shoulder areas. In severe cases, neck and shoulder movements may become restricted, affecting suffers' daily functions. Massaging has increasingly become a popular method of relieving neck and shoulder pains. Neck and shoulder massage is usually performed either by a human or by a mechanical massage device. Human massaging requires highly experienced technicians, is usually performed in a special facility, and is expensive.

Therefore, a heretofore unaddressed need exists in the art to address the aforementioned deficiencies and inadequacies.

SUMMARY OF THE INVENTION

The present invention, in one aspect, relates to a massage device. In one embodiment, the massage device comprises a base cover. The base cover has a longitudinal axis, a first end portion and an opposite, second end portion, and two slots located at the two opposite lateral sides of the first end portion.

In one embodiment, the massage device further comprises an up-down movement mechanism engaged with the base cover, and a kneading mechanism, which comprises a pair of massage heads and is engaged with a base of a movable module. The base of the movable module is engaged with the up-down movement mechanism so that the movable module can be driven up and down along the longitudinal axis of the base cover.

In one embodiment, the massage device further comprises a massage head distance adjustment mechanism. The massage head distance adjustment mechanism comprises a first motor, a first worm coaxially connected to the first motor, a first worm wheel which meshes with the first worm, a first gear which meshes with the first worm wheel, and a pair of second gears, one of which meshes with the first gear. The pair of second gears mesh with each other. In operation, the first motor drives, in sequence, the first worm, the first worm wheel, the first gear, and the pair of second gears, thereby causing the pair of massage heads to move along a corresponding pair of arc-shaped slots located on the base of the movable module, whereby adjusting the distance between the two massage heads.

In one embodiment, the massage device further comprises a massage head up-down position adjustment mechanism. The massage head up-down position adjustment mechanism comprises a pair of top bars and a top beam. Each of the pair of top bars has a portion defining a hole. The top beam has two opposite end portions, each end portion having a cylindrical member, which is received by the hole defined by the corresponding top bar. Each top bar is received by the corresponding slot located at the corresponding lateral side of the first end portion of the base cover.

In one embodiment, the massage head distance adjustment mechanism is located behind one of the massage heads. The first motor is horizontally engaged with the base of the movable module.

In one embodiment, the pair of second gears rotate in opposite directions with respect to each other, thereby causing the two massage heads to move along the two arc-shaped slots located on the base of the movable module, whereby adjusting the distance between the two massage heads.

In one embodiment, each of the pair of second gears is connected to a corresponding bracket, causing the bracket to rotate with the second gear.

In one embodiment, each of the pair of brackets has a high platform, and a low platform. The high platform is connected to a first cylindrical shaft, which is connected to a second worm wheel. The low platform is connected to a third worm wheel. The second worm wheel meshes with the corresponding third worm wheel. The pair of third worm wheels mesh with a second worm, which is driven by a second motor.

In one embodiment, the low platform defines a central hole, through which a second cylindrical shaft is coaxially mounted. The second cylindrical shaft is coaxially connected to the corresponding second gear and is fixed to the base of the movable module.

In one embodiment, the third worm wheel and the second worm wheel are enclosed in a cover. A third shaft of the massage head is engaged with the cover, forming an acute angle with the normal of the cover. A spring is coaxially engaged with the third shaft, one end of the spring being against an eccentric lip of the third shaft, the other end of the spring being against an inner wall of the massage head.

In one embodiment, the up-down movement mechanism comprises a third motor, a third worm coaxially connected to the third motor, a third worm coaxially mounted to the third motor, a screw rod coaxially connected to the fourth worm wheel. The screw rod is connected to the base of the movable module, thereby causing the movable module to move up and down along the longitudinal axis of the base cover as the third motor rotates.

In one embodiment, the cylindrical members of the top beam have a free travel distance along the longitudinal axis over the first end portion of the base cover, causing the massage heads to protrude.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numerals are used throughout the drawings to refer to the same or like elements of an embodiment, and wherein.

DETAILED DESCRIPTION OF THE INVENTION

Figure 1:
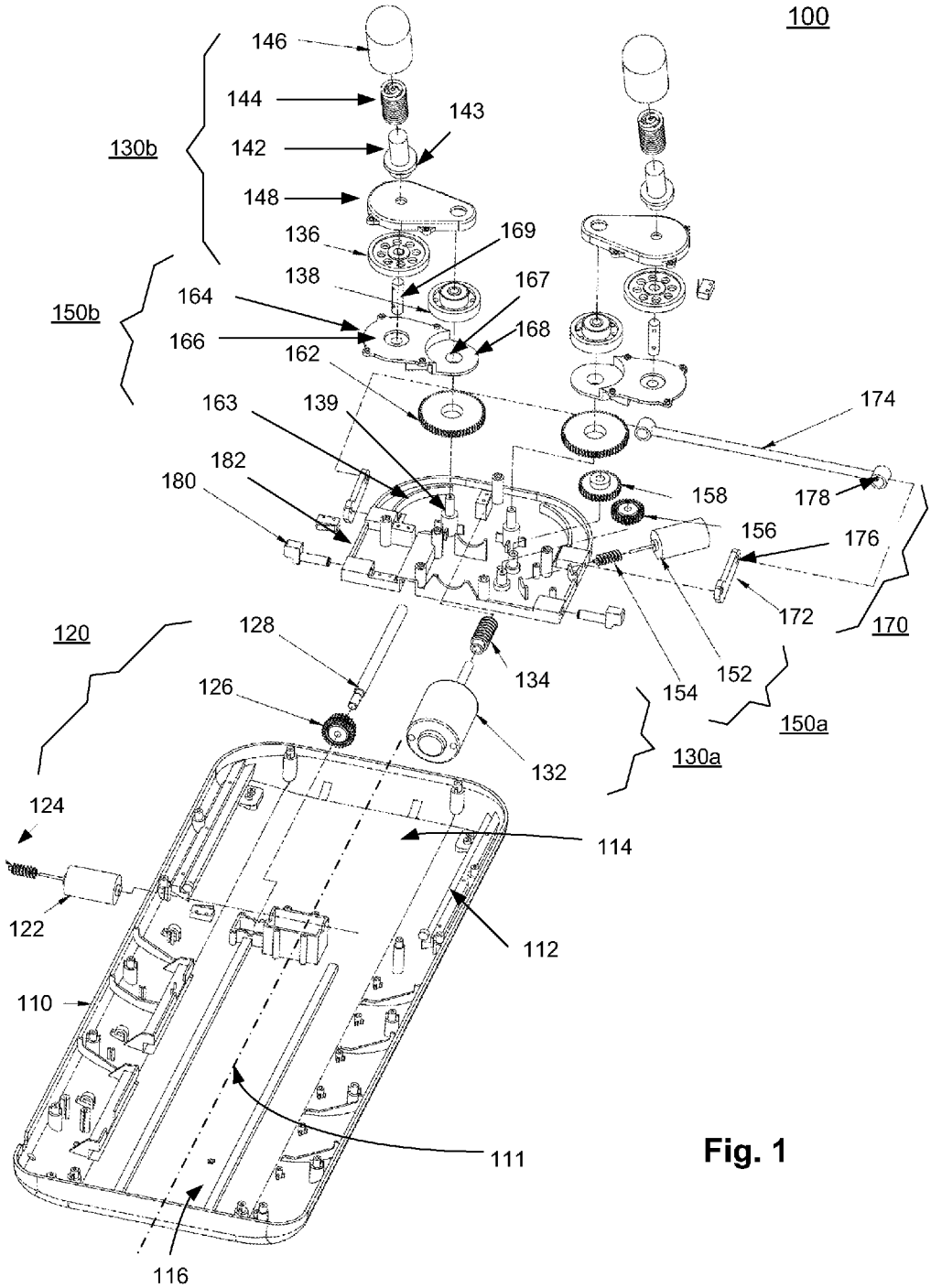
FIG. 1 shows an exploded view of a massage device according to one embodiment of the present invention.
Figure 2:
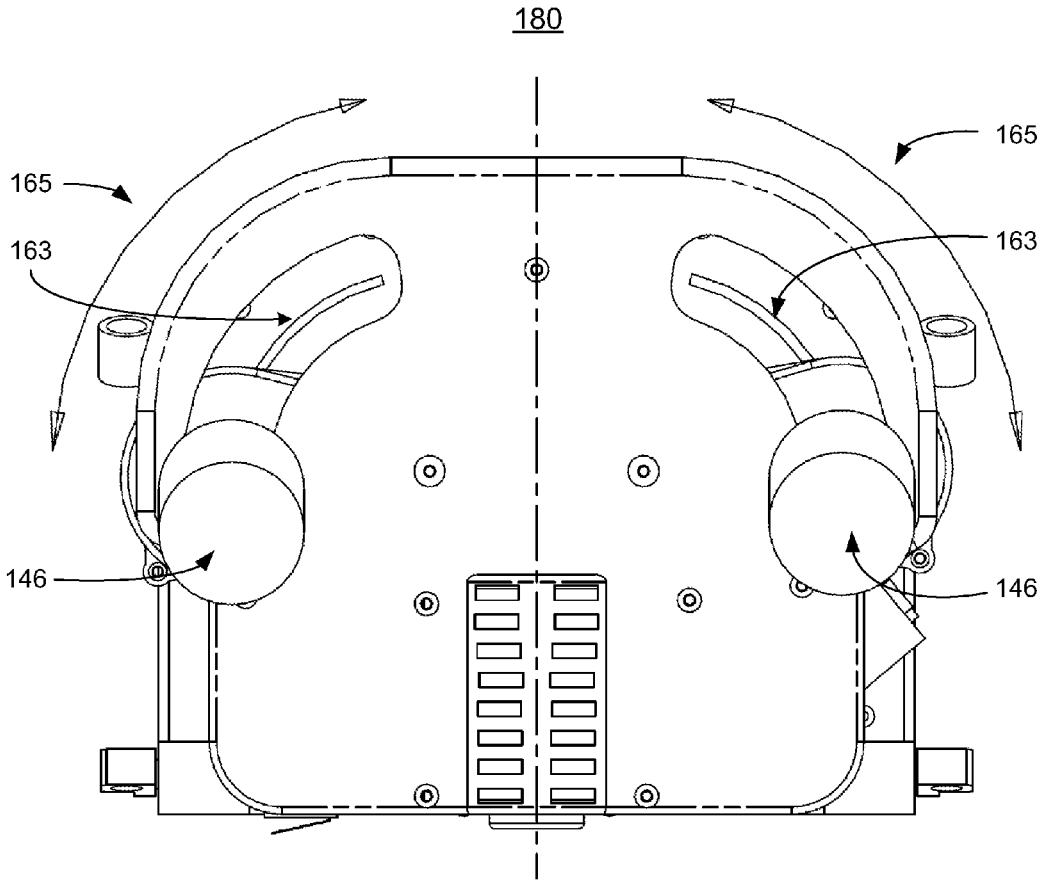
FIG. 2 shows a front view of the movable module of the massage device as shown in FIG. 1.
Figure 3:
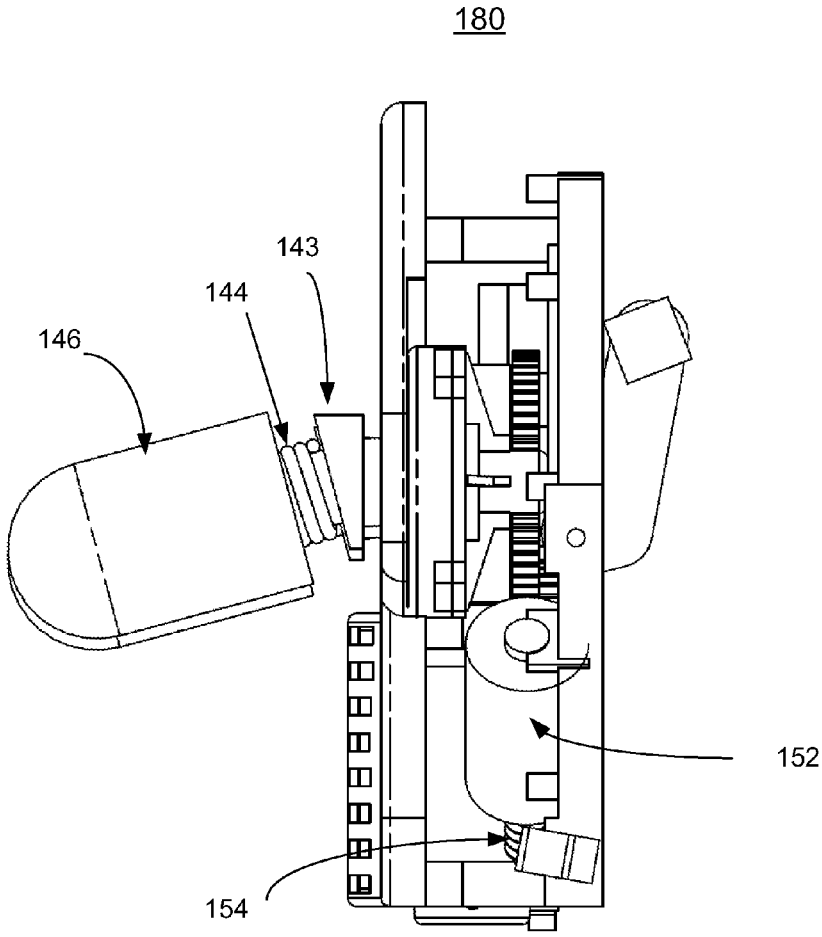
FIG. 3 shows a side view of the movable module of the massage device as shown in FIG. 1.
Figure 4:
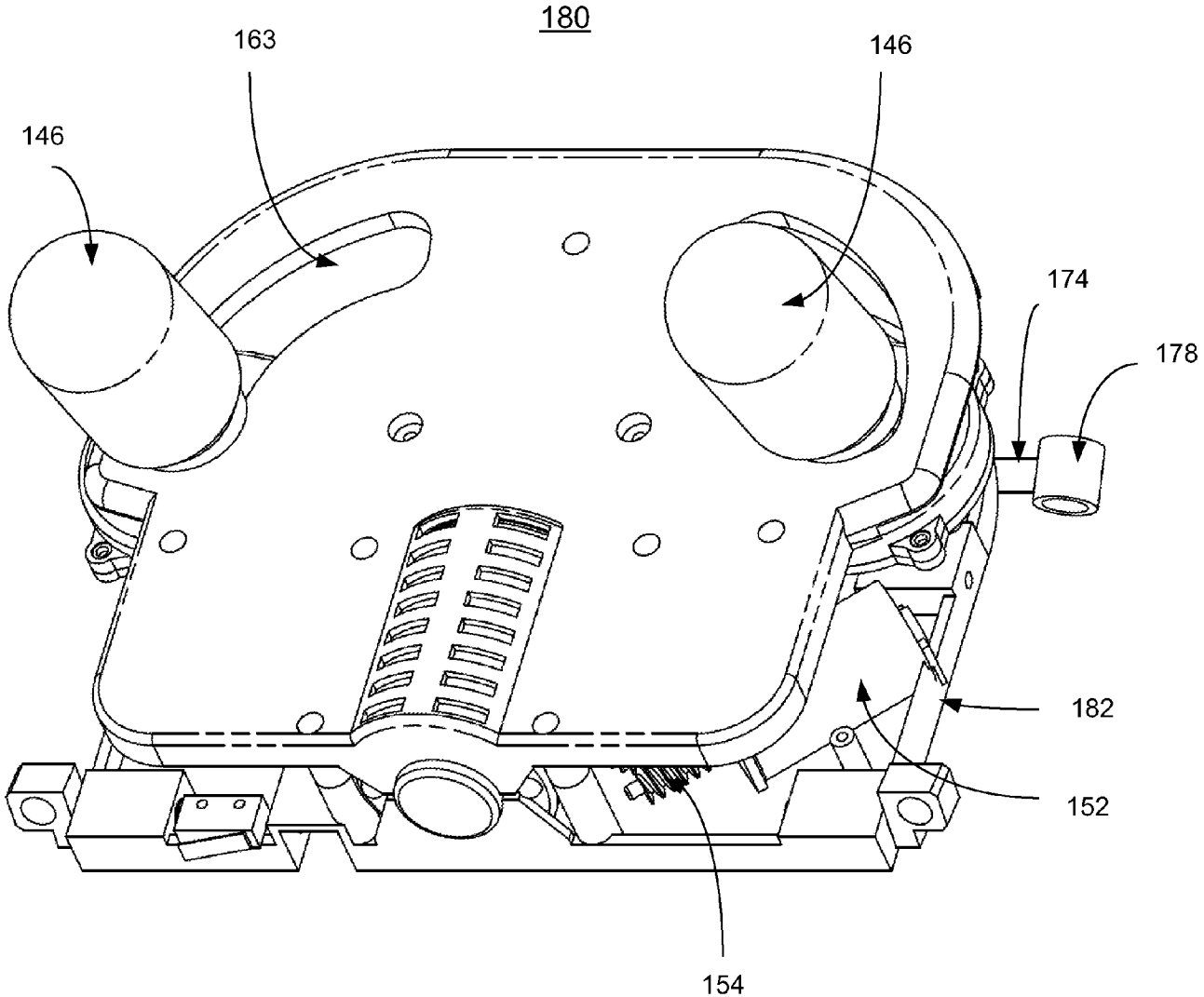
FIG. 4 shows a perspective view of the movable module of the massage device as shown in FIG. 1.
Figure 5:
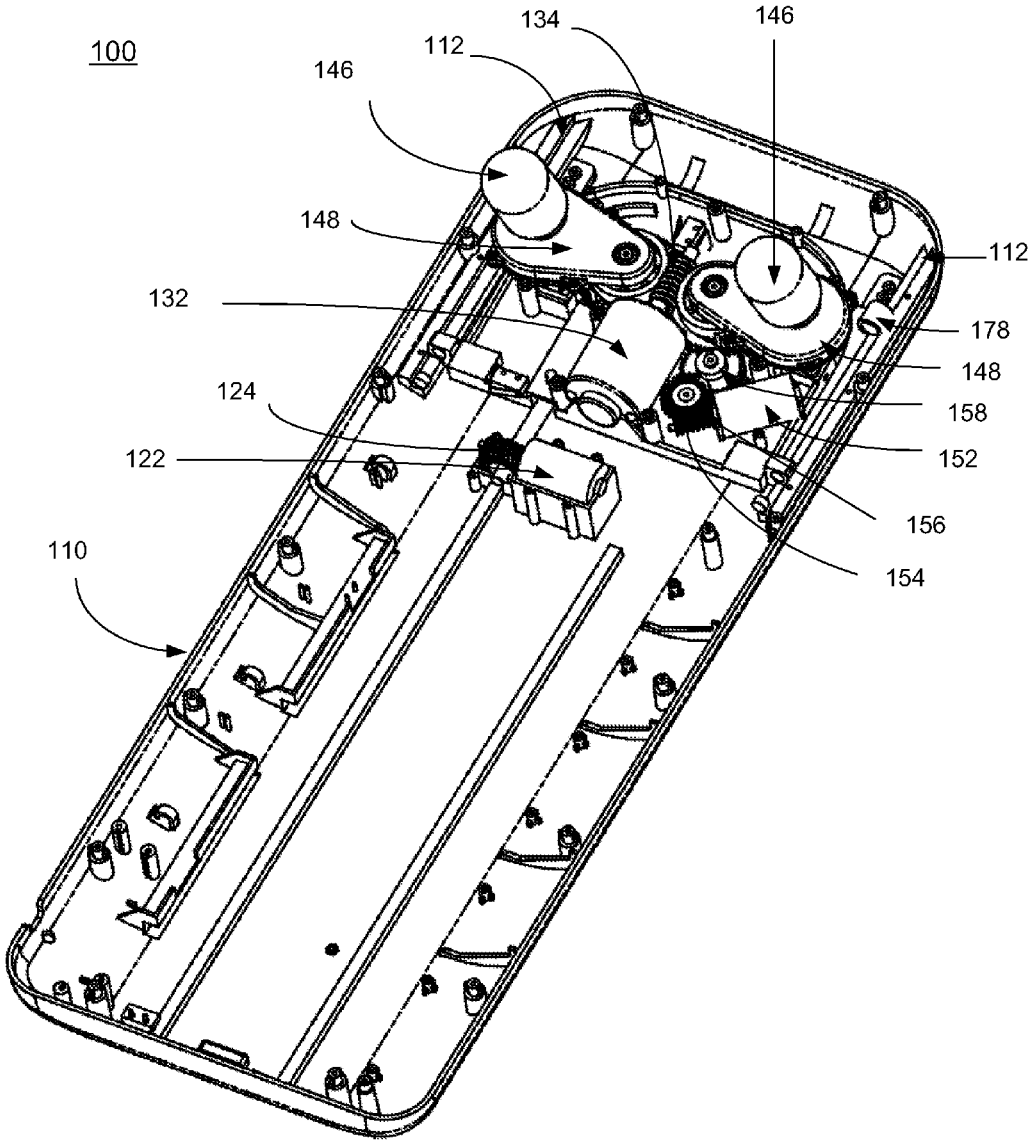
FIG. 5 shows a perspective view of the massage device as shown in FIG. 1.
Figure 6:
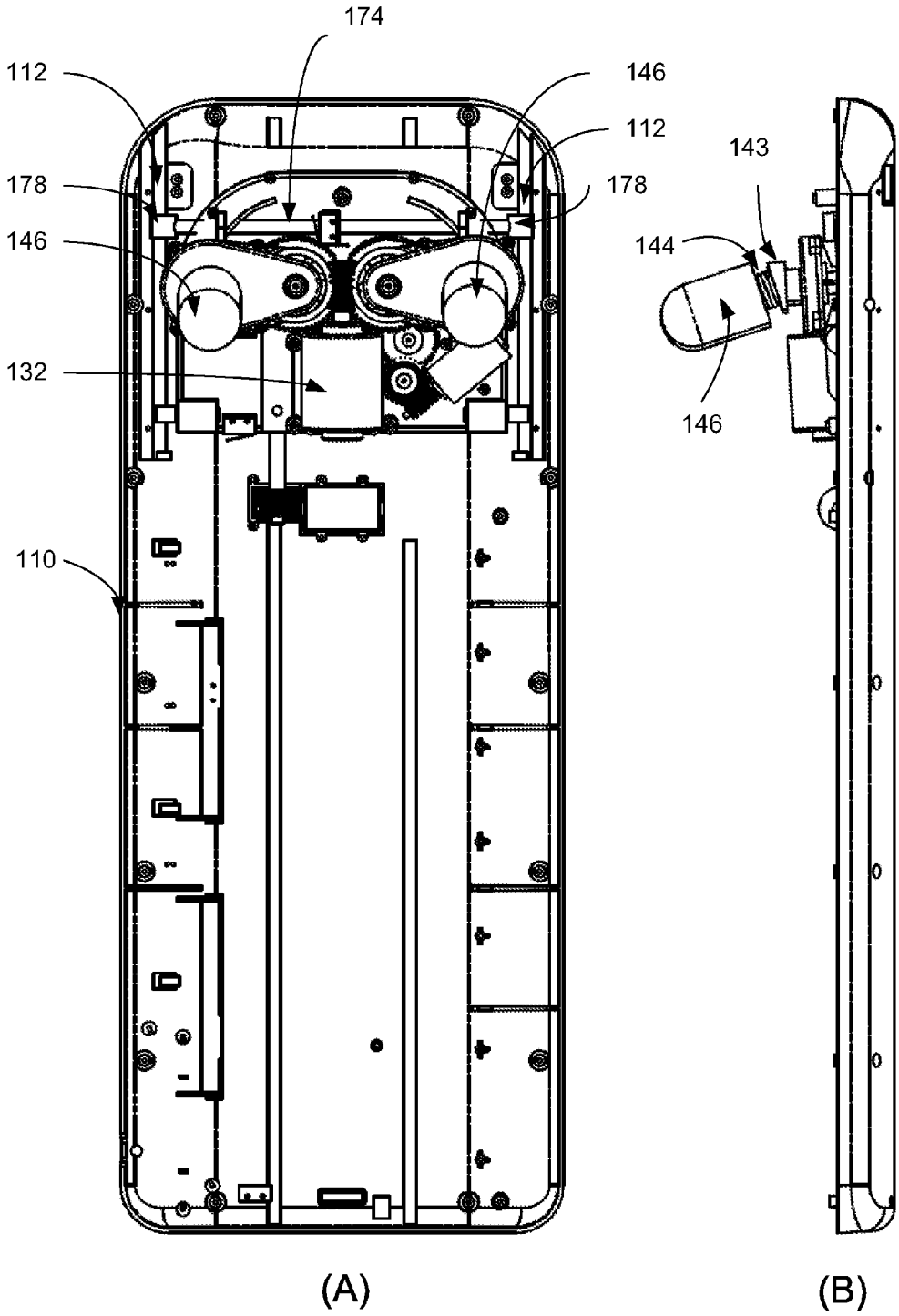
FIG. 6 shows a front view (A) and a side view (B) of the massage device as shown in FIG. 1.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

With the improved living standard in modern time, people are experiencing faster social pace and higher levels of stress. To reduce stress, various ways of relaxation and exercise have become increasingly important in people's daily lives. Consequently, various sports and health apparatuses have become household items. In particular, for people who spend long hours reading, writing, or in front of computers, they often experience severe sore and pain in the neck and shoulder areas. In severe cases, neck and shoulder movements may become restricted, affecting suffers' daily functions. Massaging has increasingly become a popular method of relieving neck and shoulder pains. Neck and shoulder massage is usually performed either by a human or by a mechanical massage device. Human massaging requires highly experienced technicians, is usually performed in a special facility, and is expensive. On the other hand, in most existing mechanical massage devices, the distance between the two massage heads is fixed. Since the size of the neck differs greatly from person to person, such massage devices cannot always achieve optimum massaging effects. In addition, for most existing mechanical massage devices, the up-down position of the massage heads are fixed. As a result, uniform massaging effect cannot be achieved. One object of the present invention is to provide a massage device with adjustable massage head distance and adjustable massage head position.

Embodiments of the present invention will be described in conjunction with the accompanying drawings in FIGS. 1-6.

Referring to FIGS. 1-6, and in particular, to FIG. 1, one embodiment of a massage device includes a base cover, the base cover having a longitudinal axis, a first end portion and an opposite, second end portion, and two slots located at the two opposite lateral sides of the first end portion. The massage device further includes an up-down movement mechanism engaged with the base cover, and a kneading mechanism engaged with a base of a movable module, which is engaged with the up-down movement mechanism so that the movable module can be driven up and down along the longitudinal axis of the base cover. The massage device further includes a massage distance adjustment mechanism, and a massage head up-down position adjustment mechanism.

Still referring to FIG. 1, the up-down movement mechanism includes a third motor, a third worm coaxially mounted to the third motor, a fourth worm wheel which meshes with the third worm, and a screw rod coaxially connected to the fourth worm wheel. The screw rod is connected to the base of the movable module, thereby causing the movable module to move up and down along the longitudinal axis of the base cover as the third motor rotates.

Still referring to FIG. 1, the kneading mechanism includes a second motor, a second worm coaxially connected to the second motor, a pair of third worm wheels which mesh with the second worm, a pair of second worm wheels, each meshing with the corresponding third worm wheel, and a pair of massage heads. In operation, the second motor drives, in sequence, the second worm, the pair of third worm wheels, the pair of second worm wheels, and the pair of massage heads.

Still referring to FIG. 1, the massage head distance adjustment mechanism includes a first motor, a first worm coaxially connected to the first motor, a first worm wheel that meshes with the first worm, a first double gear that meshes with the first worm wheel, and a pair of second gears, one of which meshes with the first double gear, and the pair of second gears mesh with each other. In operation, the first motor drives, in sequence, the first worm, the first worm wheel, the first double gear, and the pair of second gears. The pair of second gears rotate in opposite directions with respect to each other, thereby causing the pair of massage heads to move along a corresponding pair of arc-shaped slots located on the base of the movable module, whereby adjusting the distance between the two massage heads. The massage head distance adjustment mechanism is mounted behind one of the massage heads. The first motor is horizontally engaged with the base of the movable module.

Still referring to FIG. 1, each of the pair of second gears is connected to a bracket, causing the bracket to rotate with it. Each bracket has a high platform and a low platform. The high platform is connected to a first cylindrical shaft, which is connected to the second worm wheel. The low platform is connected to the third worm wheel. The low platform defines a central hole, through which a second cylindrical shaft is coaxially mounted. The second cylindrical shaft is also coaxially connected to the corresponding second gear and is fixed to the base of the movable module.

Still referring to FIG. 1, the third worm wheel and the second worm wheel are enclosed in a cover, on which a third shaft of the massage head is mounted, forming an acute angle with the normal of the cover. A spring is coaxially engaged with the third shaft. One end of the spring is against an eccentric lip of the third shaft; the other end of the spring is against an inner wall of the massage head.

Still referring to FIG. 1, the massage head up-down position adjustment mechanism includes a pair of top bars and a top beam. Each top bar having a portion defining a hole. The top beam has two opposite end portions, each end portion having a cylinder member. Each cylinder member of the top beam is received by the hole defined by the corresponding top bar. Each top bar is received by the corresponding slot located at the corresponding lateral side of the first end portion of the base cover. The cylinder members of the top beam have a free travel distance along the longitudinal axis over the first end portion of the base cover, causing the massage heads to protrude.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A massage device, comprising:

(a) a base cover, the base cover having a longitudinal axis, a first end portion and an opposite, second end portion, and two slots located at the two opposite lateral sides of the first end portion;

(b) an up-down movement mechanism engaged with the base cover;

(c) a kneading mechanism engaged with a base of a movable module, the kneading mechanism having a pair of massage heads, the base of the movable module being engaged with the up-down movement mechanism so that the movable module can be driven up and down along the longitudinal axis of the base cover;

(d) a massage head distance adjustment mechanism, having:

(i) a first motor;

(ii) a first worm coaxially connected to the first motor;

(iii) a first worm wheel meshing with the first worm;

(iv) a first gear meshing with the first worm wheel; and (v) a pair of second gears, one of the second gears meshing with the first gear, and the pair of second gears meshing with each other;

wherein, in operation, the first motor drives, in sequence, the first worm, the first worm wheel, the first gear, and the pair of second gears, thereby causing the pair of massage heads to move along a corresponding pair of arc-shaped slots located on the base of the movable module, thereby adjusting the distance between the two massage heads; and (e) a massage head up-down position adjustment mechanism, having:

(i) a pair of top bars, each top bar having a portion defining a hole; and (ii) a top beam having two opposite end portions, each end portion having a cylindrical member;

wherein each cylindrical member of the top beam is received by the hole defined by the corresponding top bar; and wherein each top bar is received by the corresponding slot located at the corresponding lateral side of the first end portion of the base cover.

2. The massage device of claim 1, wherein the massage head distance adjustment mechanism is located behind one of the massage heads; and wherein the first motor is horizontally engaged with the base of the movable module.

3. The massage device of claim 2, wherein the pair of second gears rotate in opposite directions with respect to each other, thereby causing the two massage heads to move along the two arc-shaped slots located on the base of the movable module, thereby adjusting the distance between the two massage heads.

4. The massage device of claim 3, wherein each of the second gears is connected to a corresponding bracket, causing the bracket to rotate with the respective second gear.

5. The massage device of claim 4, wherein each of the brackets has a high platform, and a low platform;

wherein each high platform is connected to a first cylindrical shaft, each first cylindrical shaft being connected to a second worm wheel;

wherein each low platform is connected to a third worm wheel;

wherein each second worm wheel meshes with the corresponding third worm wheel; and wherein the pair of third worm-wheels mesh with a second worm, the second worm being driven by a second motor.

6. The massage device of claim 5, wherein each low platform defines a central hole, through each central hole a second cylindrical shaft is coaxially mounted; and wherein each second cylindrical shaft is coaxially connected to the corresponding second gear and is fixed to the base of the movable module.

7. The massage device of claim 6, wherein the third worm wheels and the second worm wheels are enclosed in a cover;

wherein a third shaft of each massage head is engaged with the cover, forming an acute angle with the normal surface of the cover; and wherein a spring is coaxially engaged with each third shaft, one end of the spring being against an eccentric lip of the corresponding third shaft, the other end of the spring being against an inner wall of the corresponding massage head.

8. The massage device of claim 7, wherein the up-down movement mechanism comprises:

(a) a third motor;

(b) a third worm coaxially connected to the third motor;

(c) a fourth worm wheel meshing with the third worm; and (d) a screw rod coaxially connected to the fourth worm wheel;

wherein the screw rod is connected to the base of the movable module, thereby causing the movable module to move up and down along the longitudinal axis of the base cover as the third motor rotates.

9. The massage device of claim 8, wherein the cylindrical members of the top beam have a free travel distance along the longitudinal axis over the first end portion of the base cover, causing the massage heads to protrude.

* * * * *